US005375546A

United States Patent [19]

Butzen et al.

[11] Patent Number: 5,375,546

[45] Date of Patent: Dec. 27, 1994

[54] SHORTENING OF NEEDLE THREAD END AT THE BEGINNING AND END OF SEWING IN LOCKSTITCH SEWING MACHINES

[75] Inventors: Edgar Butzen, Landstuhl; Günther Denuell, Kaiserslautern; Karl-Heinz Walther, Weilerbach; Fritz Jehle, Enkenbach-Alsenborn, all of Germany

[73] Assignee: G.M. Pfaff Aktiengesellschaft, Kaiserslautern, Germany

[21] Appl. No.: 50,272

[22] PCT Filed: Nov. 21, 1991

[86] PCT No.: PCT/EP91/02200

§ 371 Date: Apr. 30, 1993

§ 102(e) Date: Apr. 30, 1993

[87] PCT Pub. No.: WO92/09735

PCT Pub. Date: Jun. 11, 1992

[30] Foreign Application Priority Data

Nov. 30, 1990 [DE] Germany ..... 4038194

[51] Int. Cl.[5] ..... D05B 65/02

[52] U.S. Cl. ..... 112/292; 112/262.1; 112/301

[58] Field of Search ..... 112/262.1, DIG. 3, DIG. 2, 112/285, 286, 289, 292, 296, 298, 381, 287, 293, 295, 300, DIG. 3

[56] References Cited

U.S. PATENT DOCUMENTS

| | | | |
|---|---|---|---|
| 1,228,871 | 6/1917 | Barron | 112/292 |
| 3,173,392 | 3/1965 | Hedegaard | 112/252 |
| 3,424,116 | 1/1969 | von Hagen | 112/298 X |
| 3,602,170 | 8/1971 | Sakashita | 112/292 |
| 3,756,177 | 9/1977 | Landwehr | 112/292 X |
| 4,077,342 | 3/1978 | Steckenrider | 112/282 |
| 4,254,725 | 3/1981 | Hager et al. | 112/292 |
| 4,455,957 | 8/1984 | Vollmar | 112/292 |
| 4,471,707 | 9/1984 | Astrupgaard et al. | 112/292 |
| 4,757,774 | 7/1988 | Jünemann | 112/292 X |

FOREIGN PATENT DOCUMENTS

| | | |
|---|---|---|
| 289806 | 4/1914 | Germany . |
| 1125742 | 10/1962 | Germany . |
| 3244996 | 4/1985 | Germany . |
| 3819135 | 7/1989 | Germany . |

*Primary Examiner*—Clifford D. Crowder
*Assistant Examiner*—Ismael Izaguirre
*Attorney, Agent, or Firm*—McGlew & Tuttle

[57] ABSTRACT

In a process and a device for shortening the needle thread end at the beginning of sewing and at the end of sewing in two-thread lockstitch sewing machines, the catch thread device (23) of an already existing thread-cutting device (22; 60; 90) is moved into its thread-catching position during the first stitch formation cycle, and it is ensured, either by the selection of a suitable point in time for moving the catch thread device (23) or by a compressed air flow discharged from a compressed air line (81), that at least the reserve-side leg of the needle thread loop will be caught by the catch thread device (23). Part of the needle thread end is cut off during the return movement of the catch thread device (23) into its starting position. Furthermore, the needle thread is clamped either under a leaf spring (44), or is pushed by a sufficiently large feed step under the pressure foot, and is thus held in a frictionally engaged manner.

21 Claims, 5 Drawing Sheets

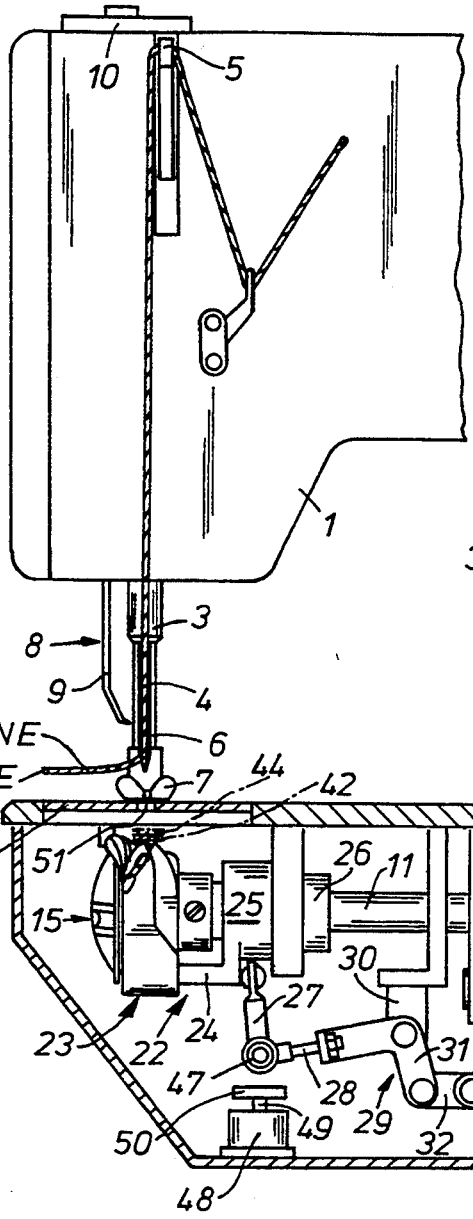
Fig. 1
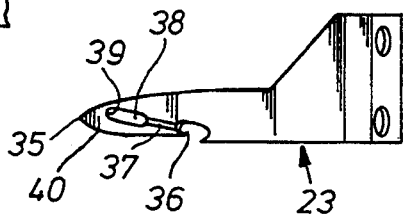
Fig.4
Fig. 2
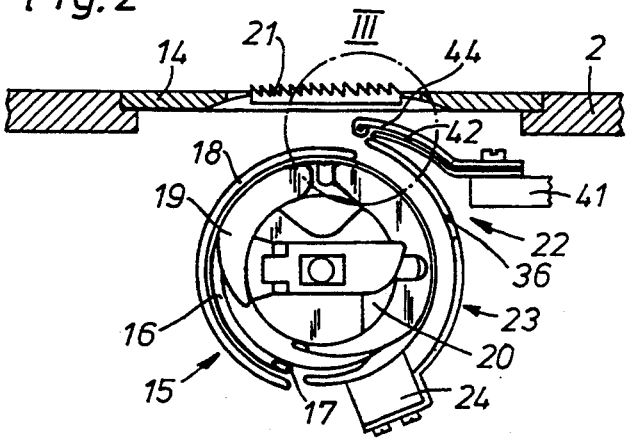
Fig.3
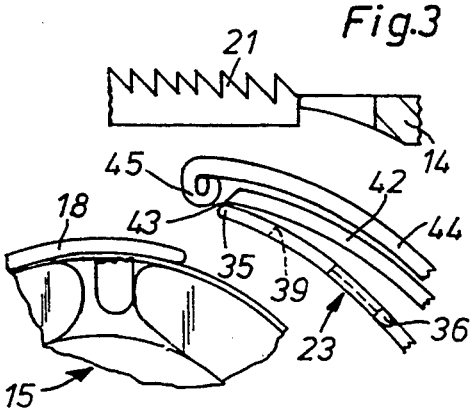

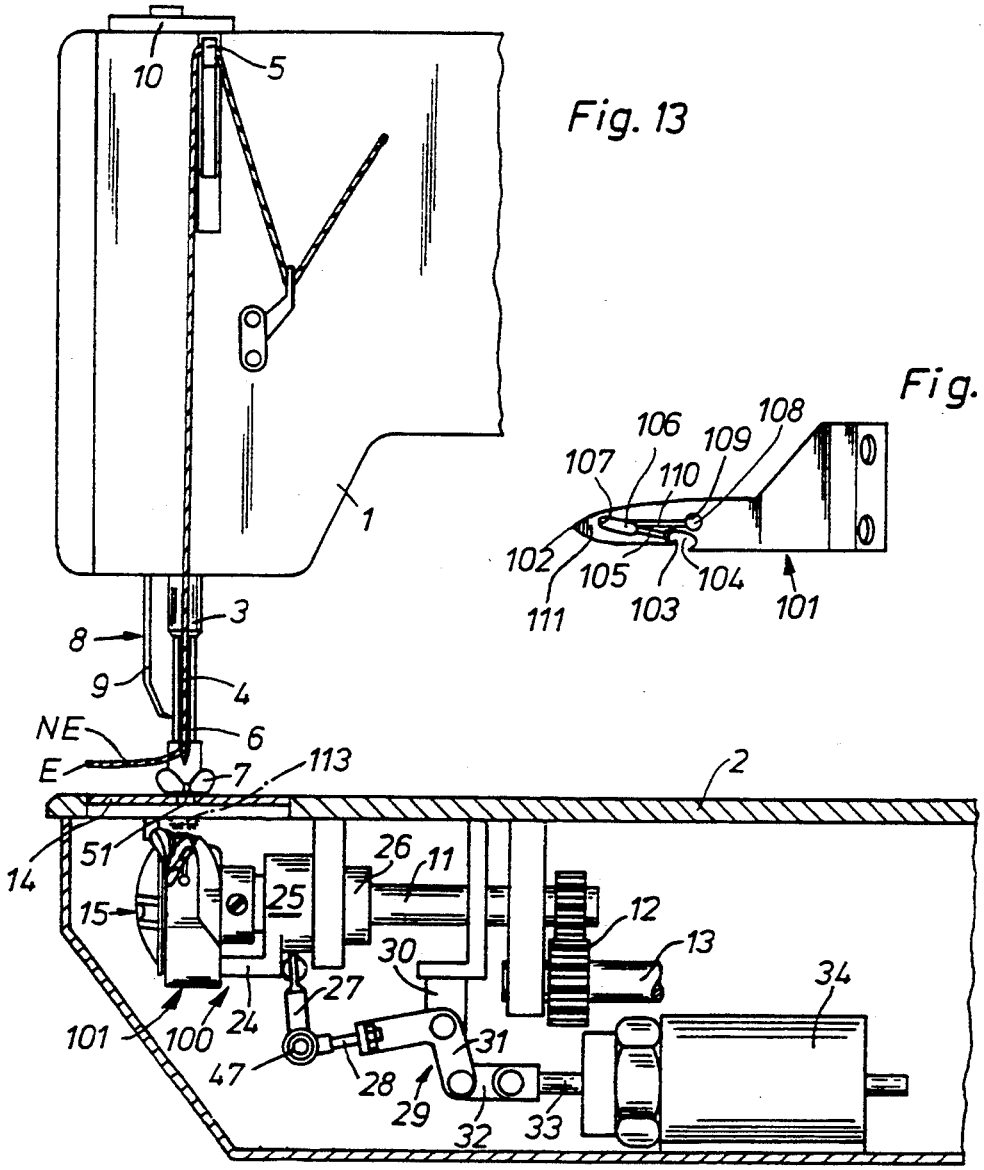
Fig. 13
Fig. 16
Fig. 14
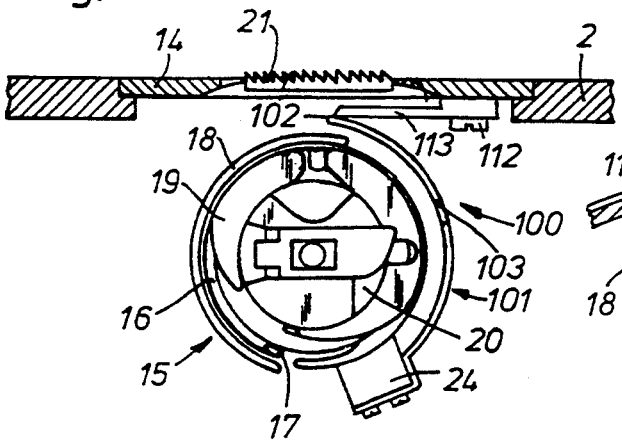
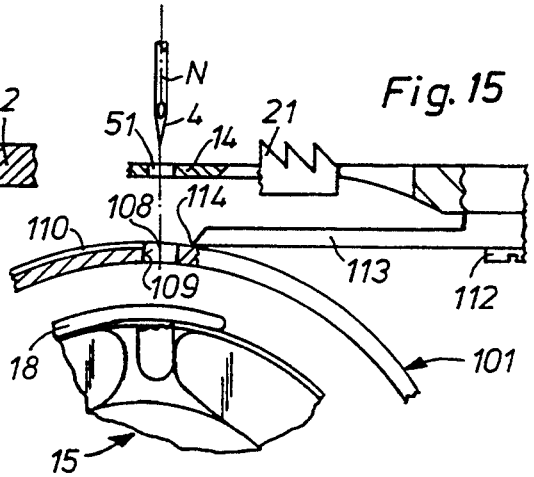
Fig. 15

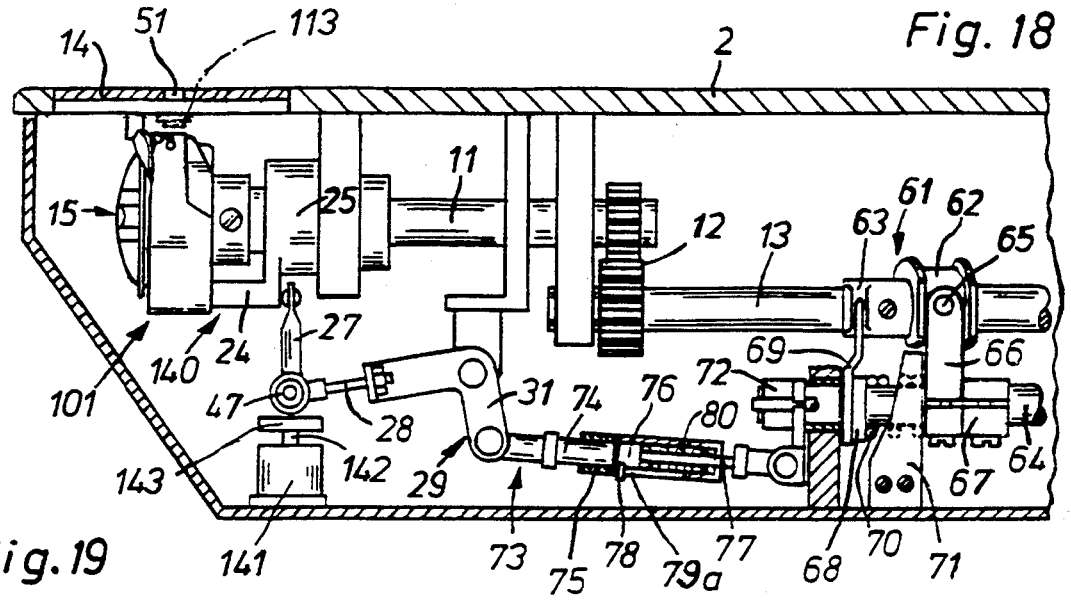
Fig. 18
Fig. 19
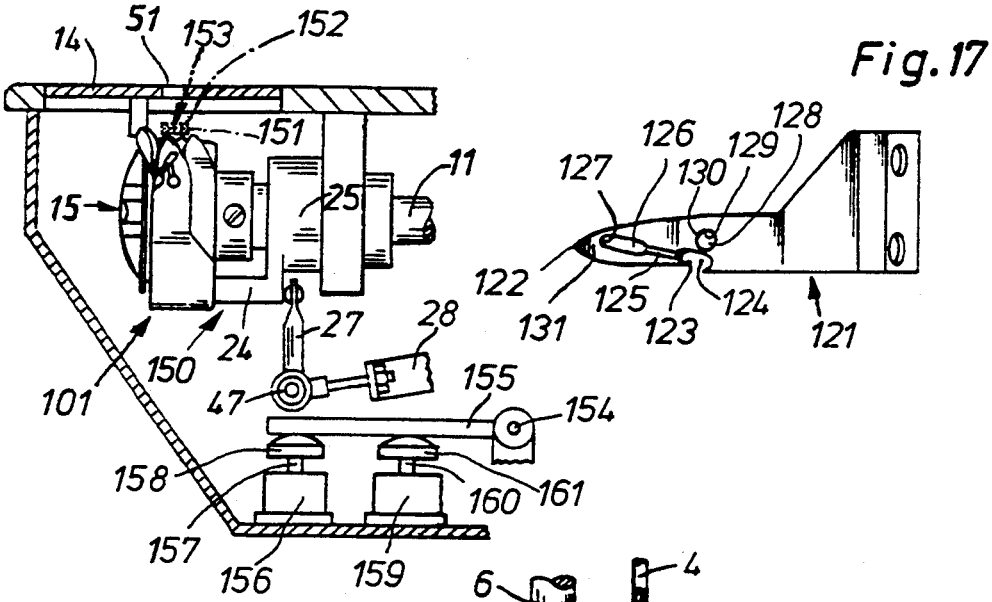
Fig. 17
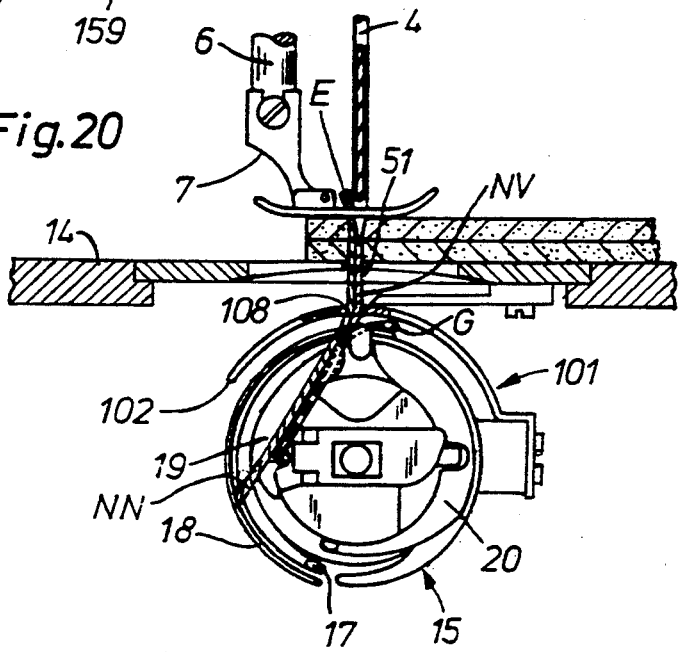
Fig. 20

SHORTENING OF NEEDLE THREAD END AT THE BEGINNING AND END OF SEWING IN LOCKSTITCH SEWING MACHINES

FIELD OF THE INVENTION

The present invention relates to a process for shortening an end of a needle thread at a beginning of the seam to be formed for a two-thread lock stitch sewing machine as well as a device for carrying out the process including a sewing machine having a needle bar with a thread-guiding needle, a hook arranged under a needle plate cooperating with the needle to form stitches, a pressure foot, a feed mechanism and a thread-cutting device.

BACKGROUND OF THE INVENTION

In many sewing operations, especially in the clothing industry, the thread ends of a seam shall be on the underside of the fabric sewn or on the inner side of an article of clothing in order to achieve an attractive appearance of a seam. This requirement is satisfied by the use of correspondingly designed thread-cutting devices, which cut the needle thread and the hook thread under the needle plate. It must be ensured at the beginning of sewing that the loose needle thread end will be pulled onto the underside of the fabric being sewn during the first stitch formation cycle. In order for a secure connection of the needle thread and hook thread to be able to take place at the beginning of a sewing process, a reserve-side needle thread end of sufficient length must be left at the end of the seam formed previously during the thread-cutting process. However, this long needle thread end, which is necessary for reliable sewing-on, leads in turn to the formation of so-called bunches of threads of unattractive appearance on the underside of the fabric being sewn at the beginning of the seam. Since such thread bunches are unacceptable in many sewn products, especially those of high quality, these must subsequently be removed in a separate, relatively time-consuming operation.

This disadvantage is eliminated in a stitch group sewing machine known from German Patent No. DE-PS 289,806 by providing a device for shortening the needle thread end at the beginning of sewing in addition to the thread-cutting device. This additional device has a catch thread arm, which ends in a catching hook and is attached to a support wheel of the thread-cutting device, which support wheel is rotatable around a vertical axis and carries two cutting knives. A spring-loaded thread clamp, which is normally open, and by which a cam surface designed at the catch thread arm can be closed, is arranged on the underside of the needle plate. A rotary movement, which is opposite the rotary movement taking place at the beginning of a thread-cutting process, is imparted to the support wheel at the beginning of a sewing process. Due to this rotary movement, the thread catch arm introduces the needle thread end, which was pulled under the needle plate during the first stitch, into the opened thread clamp. During the further movement of the catch thread arm, the thread clamp is then closed via the cam surface, and the section of the needle thread end projecting beyond this cam surface is finally cut off, while the catching hook cooperates with a separate knife. After forming two stitches, the catch thread arm is pivoted back into the starting position, and the thread clamp is again opened.

Even though the technical expense required for embodying the device is reduced in the prior-art sewing machine due to the fact that the support wheel carrying the cutting knives of the thread-cutting device also carries the catch thread arm used to catch the needle thread end, it is now necessary to move the entire support wheel within a larger angle range than during the actual thread cutting in order to shorten the needle thread end, so that the drive mechanism also must be accordingly adapted. Therefore, the prior-art process is suitable for shortening the needle thread end mainly for stitch group sewing machines, in which the special drive movements of the support wheel can be brought about in a relatively simple manner by correspondingly designing the cam plate.

SUMMARY AND OBJECTS OF THE INVENTION

The primary object of the present invention is to provide a process and a device for shortening the needle thread end at the beginning of sewing, which process and device can be embodied with a small amount of technical expense.

According to the invention, a process is provided for shortening the end of a needle thread at a beginning of the seam to be formed with a two-thread lock stitch sewing machine. The invention also includes a device for performing the process including a sewing machine having a needle bar with a thread guiding needle, a hook which cooperates with the thread-guiding needle and is arranged under a needle plate, a pressure foot, a feed mechanism and a thread-cutting device which contains a catch thread device with a catching element with a thread-catching area, the catch thread device being movable into a thread-catching position and a knife. The process includes the steps of moving the catch thread device into the thread-catching position prior to or during the first stitch formation cycle. At least a section of the reserved side leg of the needle thread loop, or the needle thread end is then positioned crossing the plane of the path of movement of the catch thread device within the thread-catching area of the catch thread device. The section of the needle thread end is then cut during a further or return movement of the catch thread device into the cutting position. The sewing machine is preferably provided with a hook doubly rotating around a horizontal axis and the thread-cutting device has a drive mechanism that can be switched on as a function of the movement process of the sewing machine. The drive mechanism of the thread-cutting device can be switched on at two different angle positions of the hook before performing the thread-cutting process taken place at the end of the seam and for performing the shortening of the end of the needle thread, which takes place at the beginning of the seam. An open end piece of a compressed air line may be arranged and oriented under the needle plate in an area of the hook such that the compressed air flow discharged from the end piece extends above the hook from its rear side in a direction of its front side and essentially in parallel to the axis of rotation of the hook. Both catching elements or at least the additional catching element is formed by a recess, a cutting edge, which cooperates with the knife, is associated with the additional catching element.

By using the catch thread arm of a thread-cutting device already present to shorten the needle thread end, and to move it along the same path of movement as in the case of normal thread cutting, which takes place at the end of the seam, wherein either the reserve-side leg of the needle thread loop, or generally the needle thread end, rather than the fabric-side leg, is caught and fed to the cutter in this case according to the present invention, the shortening of the needle thread end can be performed in a relatively simple manner, i.e., an existing thread-cutting device can also be used to shorten the needle thread end at the beginning of sewing without an appreciable technical expense in new sewing machines and already existing sewing machines alike.

According to future aspects of the invention it possible for the catch thread arm to catch the reserve-side leg of the needle thread loop or, if the thread loop is already untied, the needle thread end. To shorten the needle thread end at the beginning of sewing, it is necessary to move the catch thread arm into its catching position earlier than in the case of thread cutting at the end of the seam.

According to a second possibility of catching the reserve-side leg of the needle thread loop or the needle thread, the catch thread device can be moved to shorten the needle thread end at the same relative point in time in relation to the hook position as in the case of thread cutting at the end of the seam, so that the drive for the catch thread arm can be actuated in the same manner.

While the catch thread arm is moved into the catching position in the course of the first stitch formation cycle in the two processes mentioned immediately above, and correct coordination of the movement of the catch thread arm in time with the instantaneous position of the needle thread end or the needle thread loop is important for catching the needle thread end, or even an auxiliary means is needed for moving the needle thread end into a position in which it can be caught, highly reliable catching of the needle thread end is achieved according to another aspect of the invention due to the fact that the catch thread device, which is provided with a recess forming an additional catching element, is brought, before the needle first passes through the stitch hole of the needle plate, into a position in which the needle penetrates into the recess of the catch thread device, thus forcibly introducing the needle thread end into this recess and making it available to the additional catching element.

In sewing machines in which the needle does not participate in the feed movement of the fabric being sewn, and the stitch hole of the needle plate can therefore be small, holding the needle thread end, which is necessary for the first concatenation of the shortened needle thread end with the hook thread, is brought about by the fabric being sewn being fed, after a section of the needle thread end has been cut off, to the extent that the section of needle thread located between the pressure foot and the needle plate is pulled out in the shape of a U in the horizontal direction, and is thus held in a frictionally engaged manner between the pressure foot and the top side of the fabric being sewn, as well as between the needle plate and the underside of the fabric being sewn.

This manner of holding is impractical for needle feed sewing machines. Since the stitch hole in needle feed sewing machines is an elongated hole extending in the direction of feed, whose length depends on the greatest possible stitch length that can be set, the clamping effect would appear only after at least one additional feed step, and only after a plurality of feed steps in the case of small stitch length settings, namely, only when the section of the needle thread located within the fabric being sewn has been fed beyond the end of the stitch hole and has thus come to lie between the needle plate and the pressure foot sole. It is therefore more advantageous for needle feed sewing machines to hold the needle thread end by means of a thread clamp for connecting it to the hook thread.

The division of the return movement of the catch thread device into two steps makes it possible to design or arrange the thread clamp associated with the catch thread device such that the needle thread end is held by the needle clamp only in the intermediate position of the catch thread device, and it is released after the further movement of the catch thread device or during its return into the starting position. This makes it unnecessary to associate the thread clamp with a closing and opening mechanism.

According to a further aspect of the invention, the drive mechanism of the thread-cutting device can be turned on at two different angle positions of the hook. While it is advantageous for thread cutting at the end of the seam to move the catch thread device into its catching position only when the two legs of the needle thread loop have fallen off from the thread guide plate of the hook, and extend in different directions in relation to the stitch hole, so that the catch thread device catches only the fabric-side loop leg to obtain short thread ends on the fabric being sewn, it is advantageous, for shortening the needle thread end at the beginning of sewing, to move the catch thread device into its catching position at an earlier point in time, namely, at a time when the two loop legs are, or, if the needle thread loop is already untied, the needle thread end is still in contact with the thread guide plate of the hook, so that the catch thread device is also able to catch the reserve-side loop leg or the needle thread end.

The use of a pneumatic cylinder as the drive mechanism for the thread-cutting device makes it possible to bring about different movements in time of the catch thread device in a particularly simple manner.

The compressed air flow discharged from the compressed air line ending in the area of the hook not only brings the reserve-side loop leg or the needle thread end into a position in which the reserve-side loop leg or the needle thread end can be caught by the catch thread device, but it also blows the needle thread end cut off away from the area of the hook, thus preventing this thread section from being again caught by the hook and tied into the seam.

Since the path of movement of the catching element of the catch thread device, which is used to catch the threads to be cut off at the end of the seam, is generally located at a greater distance from the stitch hole, it is suggested that an additional catching element, designed as a recess, be provided at the catch thread device, and this recess may also form the other catching element, if desired.

Absolutely reliable catching of the needle thread by the catch thread device is guaranteed if the recess is designed as a hole according to claim 10. Since a hole has a lateral limiting wall that is closed in itself, the needle thread end, which is pulled under the needle plate during the first stitch formation process and then hangs down freely and in an uncontrolled manner either until it is introduced into a thread clamp or, if no thread clamp is present, until the first connection to the hook thread, cannot deviate to the side, as in the case of an, e.g., slot-like recess.

Two alternative solutions for designing or arranging the cutting edge cooperating with the knife are disclosed. A first solution involves the edge area of the recess, which edge area is located on a top side of the catch thread device and is directed opposite knife, is designed as a cutting edge. According to a second solution the catch thread device is a cutting edge, which is designed on its top side and cooperates with the knife, in that a recess is connecting to the cutting edge via a thread-receiving groove.

When a pneumatic cylinder is used as the drive mechanism, the position of the recess or hole is selected, such that the thread-catching position of the catch thread device is always the same for thread cutting at the end of the seam and for shortening the needle thread end at the beginning of the seam.

Since the catch thread device must be moved into the thread-catching position for catching the needle thread at the beginning of a sewing process at a different point in time in relation to the hook position than for catching the needle thread and the hook thread at the end of a sewing process, for the case in which the drive mechanism of the thread-cutting device has a cam, that the catch thread device be associated with an additional drive mechanism, and that one of the gear members be designed as a spring-loaded gear member, e.g., in the form of a telescoping connecting rod as a result of which a restoring force builds up on actuation of the additional drive mechanism. Due to the spring-loaded design of one of the gear members, the cam can have a cam groove to be traced in a positive-locking manner, and the tracing member can remain in its relative tracing position in relation to the cam groove during the movement of the catch thread device into the thread-catching position, which takes place prior to the beginning of sewing.

The restoring force acting on the gear member of spring-loaded design, which is generated during the forward movement of the catch thread device into the thread-catching position, which movement is brought about by the additional drive mechanism, makes it possible to design the additional drive mechanism as a pneumatic cylinder and to have it act on one of the gear members of the thread-cutting device only in a spring-actuated manner. After the piston rod of the pneumatic cylinder has withdrawn, the catch thread device is returned into its starting position in this case by the restoring force generated previously.

According to a further aspect of the invention a locking member, which can be introduced into and removed from the path of movement of the catch thread device or the gear of the thread-cutting device, is provided to stop the catch thread device in an intermediate position. If a pneumatic cylinder is the drive mechanism of the thread-cutting device, this offers the advantage that the interruption of the movement of the catch thread device, which is brought about by the locking member being brought into the operating position, is completed without problems after withdrawal of the locking member, without the need to again trigger or switch on the drive mechanism.

If, in contrast, the drive mechanism of the thread-cutting device contains a cam that can be driven by the sewing machine, it is advantageous, if the catch thread device is to be held in an intermediate position by a locking member that can be engaged and disengaged, to design, one of the gear members as a spring-loaded gear member, e.g., in the form of a telescoping connecting rod. A gear member of spring-loaded design makes it possible in this case not to have to interrupt the drive connection between the cam and the subsequent gear member cooperating with it during the engagement of the locking member, and to store the residual drive impulse originating from the cam by the tensioning of the spring element of the said gear member of spring-loaded design for returning the catch thread device into its starting position and to release it after disengagement of the locking member, after which the catch thread device is returned into its starting position by means of this spring element.

If a needle thread clamp is associated with the thread-cutting device, which has a drive mechanism provided with a cam, the additional drive mechanism is to be designed such that it shall be able to move the catch thread device into two operating positions, one of them being the thread-catching position at the beginning of a sewing process, and the other being a thread-clamping position.

The additional drive mechanism, which can be switched into two operating positions, is embodied by two pneumatic cylinders, which perform different effective strokes. This can be achieved. e.g., either by using two pneumatic cylinders with different stroke lengths, or by two pneumatic cylinders with equal stroke lengths acting on an interconnected lever at two points located at different radial distances from the axis of the lever.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a partially cutaway view of a partial area of a sewing machine with a thread-cutting device, wherein the drive of the thread-cutting device is formed by a pneumatic cylinder;

FIG. 2 is an enlarged side view of the hook and of the thread-cutting device;

FIG. 3 is an enlarged detail of area III in FIG. 2;

FIG. 4 shows a top view of the catch thread device of the thread-cutting device;

FIG. 13 is a partially cutaway view of a partial area of a sewing machine with a thread-cutting device, whose thread catch device has an additional catching element for the needle thread end, and whose drive is formed by a pneumatic cylinder;

FIG. 14 is an enlarged side view of the hook and of the thread-cutting device according to FIG. 13;

FIG. 15 is an enlarged detail from FIG. 14, wherein the catch thread device is in the catching position;

FIG. 16 is a top view of the catch thread device of the thread-cutting device;

FIG. 17 is a top view of another embodiment of the catch thread device;

FIG. 18 is a partially cutaway view of a partial area of a sewing machine with a thread-cutting device, whose catch thread device has an additional catching element for the needle thread end, and whose drive is formed by a cam;

FIG. 19 is a partially cutaway view of a partial area of a sewing machine and of a thread-cutting device according to FIG. 18, in which an additional drive mechanism is able to move the catch thread device into two positions; and FIG. 20 is a top view of the hook showing the course of thread during the performance of the first stitch formation cycle in a side view of the hook.

DETAILED DESCRIPTION OF THE PREFERRED EMBODIMENT

Exemplary Embodiment 1

Figure 5:
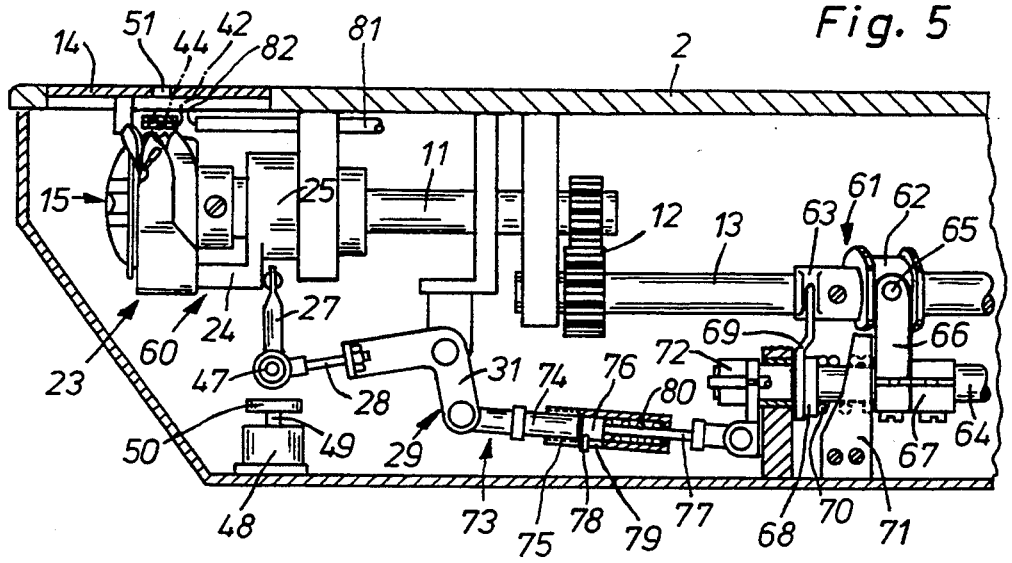
FIG. 5 is a partially cutaway view of a partial area of a sewing machine with a thread-cutting device, wherein the drive of the thread-cutting device is derived from a cam.

FIG. 1 shows the head 1 and the base plate 2 of a sewing machine. The needle bar 3, which is driven in the known manner and carries a thread-carrying needle 4, is arranged in the said head 1. A take-up lever 5, likewise driven in the known manner, and a pressure bar 6, which carries a pressure foot 7, are also arranged in the said head 1. A prior-art thread wiper 8, of which only the wiper lever 9, made of wire, and the pneumatic cylinder 10 used to drive it, are shown, is arranged on the rear side of the said head 1.

A hook drive shaft 11, which is in drive connection with a lower main shaft 13 via a speed-increasing drive 12, is mounted in the said base plate 2. A doubly rotating two-thread lockstitch hook 15 is attached to the front end of the said hook drive shaft 11 under the said needle plate 14. The said hook 15 contains the hook body 16 with the hook tip 17 in the known manner. The thread guide plate 18 is attached on the circumferential side of the said hook body 16. A bobbin case holder 19 and a bobbin case 20 are inserted into the said hook body 16.

The feed dog 21 of the feed mechanism of the sewing machine, is in drive connection with the said drive shaft 13 in a known manner, and is therefore not shown. This consequently performs rectangular movements and extends above the said hook 15.

A thread-cutting device 22 is arranged under the said base plate 2. The said thread-cutting device 22 has a catch thread device 23, which is arranged coaxially with the said hook 15, and is in its starting position in FIG. 2. The said catch thread device 23 is attached to an arm 24 of a sleeve 25, which is rotatably mounted on a bearing bush 26 of the said hook drive shaft 11. A connecting rod 27, which is connected to a longitudinally adjustable arm 28 of an angle lever 29, which latter is carried by a bearing block 30 that is an integral part of the housing, is hinged to the said arm 24. The other arm 31 of the said angle lever 29 is connected to the piston rod 33 of a pneumatic cylinder 34 via a connecting rod 32. The design and the control circuit of the said pneumatic cylinder 34 correspond to the pneumatic cylinder and the pneumatic cylinder control circuit for a thread-cutting device, which are disclosed in DE 32,44,996 C2.

The said catch thread device 23 has a separating tip 35 (FIG. 4), designed at the free end, and a thread-catching barb 36, which is directed in the opposite direction. A flat groove 37, which opens into a continuous elongated hole 38, is designed at the foot of the said barb 36. The edge 39 of the said elongated hole 38 located adjacent to the said separating tip 35 is designed with sharp edges, and is used as a cutter. The front section of the said catch thread device 23 between the said separating tip 35 and the said edge 39 is designated by 40. A cutting knife 42, whose cutting edge 43 (FIG. 3) is in contact with the top side of the said catch thread device 23 and cooperates with the said edge 39, is attached to a projection 41 (FIG. 2) of the said base plate 2.

Figure 12:
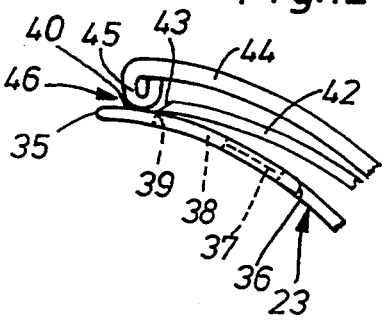
FIG. 12 is an enlarged representation of a thread clamp.
Figure 10:
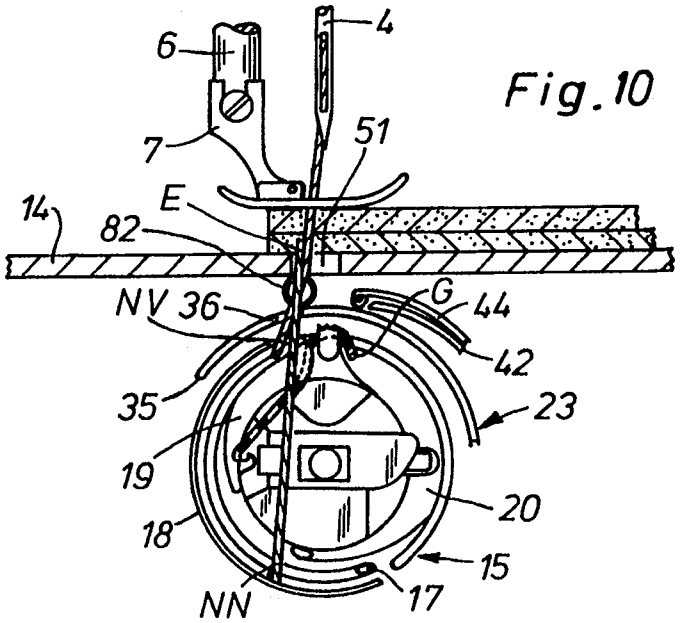
FIG. 10 is an enlarged side view of the hook showing the course of the thread during thread catching, in which case both legs of the needle thread loop have fallen off from the thread guide plate of the hook and are held by a compressed air flow in the catching position.
Figure 11:
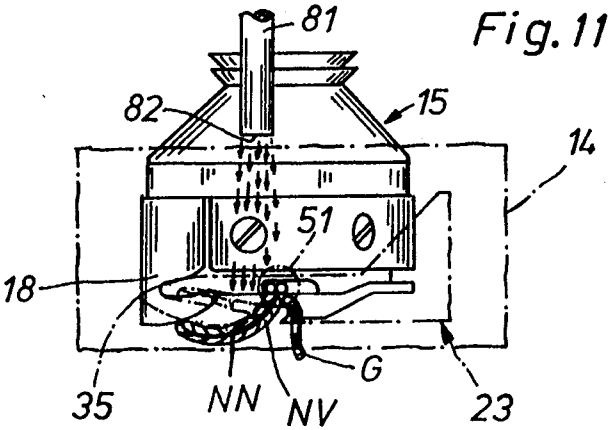
FIG. 11 is a top view of the hook showing the course of thread at the same point in time as in FIG. 10.

A leaf spring 44, which projects above the said cutting edge 43 and ends in a bent end or clamp piece 45, which extends into the path of movement of the said catch thread device. The leaf spring 44 is attached to the said projection 41 above the said cutting knife 42. Together with the said section 40 of the said catch thread device 23, the said leaf spring 44 forms a thread clamp 46 (FIG. 12).

A pneumatic cylinder 48, whose piston rod 49 carries a stop plate 50 acting as a locking member, is arranged under the said hinge 47 between the said connecting rod 27 and the said arm 28 of the said angle lever 29.

The said above-described thread-cutting device 22 differs from the thread-cutting device disclosed in DE 32,44,996 C2 cited only by the fact that the said leaf spring 44 and the said pneumatic cylinder 48 with the said stop plate 50 are additionally provided in it.

Mode of Operation

The mode of operation of the said thread-cutting device during thread cutting at the end of a sewing process is the same as that of the thread-cutting device according to DE 32,44,996 C2, so that this function need not be explained in greater detail. It should only be pointed out that the said catch thread device 23 is moved in this case from its starting position into the thread-catching position only when the said thread guide plate 18 has already withdrawn from the two legs NN and NV of the needle thread loop, or the legs NN and NV have already fallen off from the said thread guide plate 18. This point in time is of significance because, in the case of a two-thread lockstitch rotary hook doubly rotating around a horizontal axis, the fabric-side loop leg NN is moved past the front side of the bobbin case 20, and the reserve-side loop leg NV is moved past the rear side of the said bobbin case holder 19, and the two legs NN and NV thus extend at different angles to the said stitch hole 51 of the said needle plate 14 after falling off from the said thread guide plate 18. In the case of this thread course, the said catch thread device 23 with its said separating tip 35 is able to pass reliably through between the two loop legs NN and NV, and the fabric-side loop leg NN is caught by the said barb 36, is fed to the said cutting knife 42 during the return movement of the said catch thread device 23, and the reserve-side loop leg NV is kept away from the said cutting knife 42. By cutting off the fabric-side loop leg NN, a short needle thread end is obtained on the fabric in the area of the end of the seam, as desired, on the one hand, and, on the other hand, a long reserve-side needle thread end, which is necessary for reliably connecting the needle thread end to the hook thread at the beginning of the next sewing process, is obtained. The additional term "needle thread end," which is designated by the reference numeral NE, is defined here as the thread section extending to the actual end E of the needle thread.

At the beginning of a sewing operation carried out at reduced speed, the said needle 4 pulls part of the loose needle thread end NE through the said stitch hole 51 in the downward direction (it is achieved due to the said thread wiper 8 that the said needle thread end NE will not come under the said pressure foot 7 and will not be held by it), after which the needle thread end NE is caught by the said hook tip 17 and is moved as a thread loop around the bobbin housing formed by the said bobbin case holder 19 and the said bobbin case 20. As was mentioned, the reserve-side loop leg NV now extends behind the said bobbin case holder 19, while the other loop leg, which leads to the end E of the needle thread, extends on the front side of the said bobbin case 20. This loop leg is comparable to the loop leg that forms the fabric-side loop leg NN after the first stitch formation. The loop leg leading to the actual end E is therefore also designated by NN.

It should be mentioned here that a certain frictional force is exerted on the needle thread introduced into the fabric during the first stitch formation cycle in the case of thick and firm fabrics. Due to this frictional force, the loop leg NN leading to the end E is held after the needle thread loop has been caught by the said hook tip 17, while the said hook 15 pulls in thread from the slack thread formed by the said take-up lever 5 through the needle groove during the time during which the said needle 4 is penetrated into the fabric. As is shown in FIGS. 8 through 11, the said hook 15 is thus able to form a complete needle thread loop already during the first stitch formation cycle.

In contrast, a much lower frictional force is exerted on the needle thread in the case of thin and looser fabrics. This causes the said hook 15 to pull downward not only thread from the slack thread formed by the said take-up lever 5, but at the same time also the free end E of the needle thread, so that only a small thread loop can be formed, and this small thread loop is already untied in the hook positions shown in FIGS. 8 through 11. After untying of the needle thread loop, the needle thread end NE extends hanging down freely under the said needle plate 14, and is in the same position as a reserve-side loop leg NV, namely, behind the said bobbin case holder 19. Since the conditions occurring during the catching of a freely hanging needle thread end NE by the said catch thread device 23 are the same as during the catching of the reserve-side loop leg NV, the further course of the function will be explained only on the basis of the situation in which the needle thread loop is still present at the time of catching of the thread.

Figure 8:
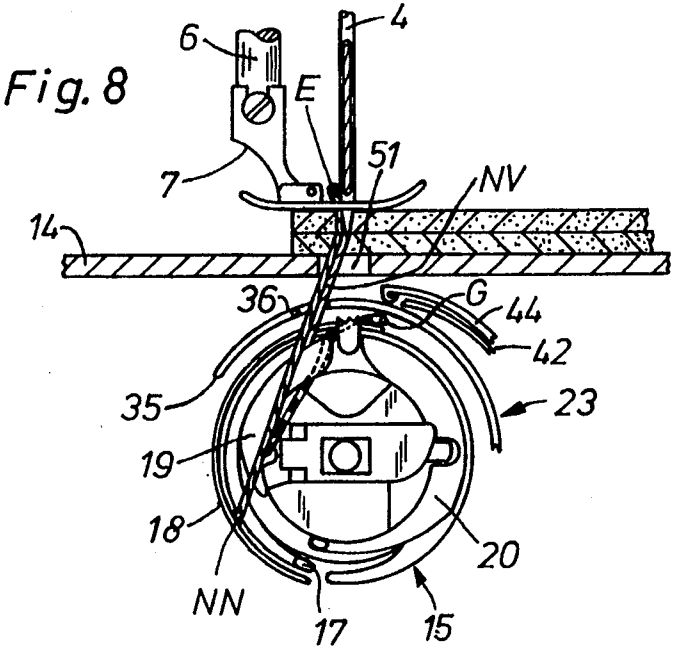
FIG. 8 is an enlarged side view of the hook showing the course of the thread during thread catching in a side, in which case both legs of the needle thread loop are still in contact with the thread guide plate of the hook.
Figure 9:
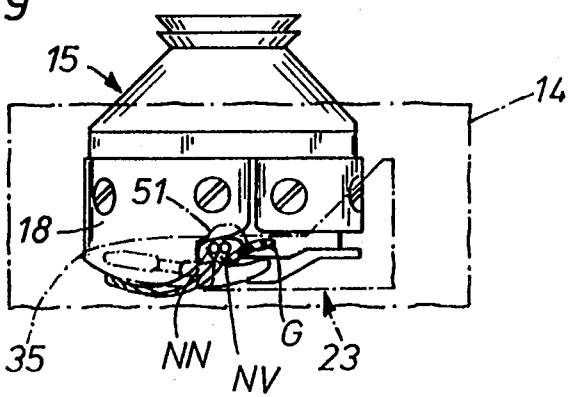
FIG. 9 is, in a top view of the hook, showing the course of the thread at the same point in time as in FIG. 8.

In the rotary position of the said hook 15 shown in FIG. 8, in which the end part of the said thread guide plate 18 is still in the area of the said stitch hole 51, and both loop legs NN and NV are consequently in contact with the said thread guide plate 18 next to each other, pressure is admitted to the said pneumatic cylinder 34, and, as a consequence of this, the said catch thread device 23 is moved from its starting position into the thread-catching position shown in FIGS. 8 and 9, in which the said barb 36 is located in front of the two loop legs NN, NV. After the said catch thread device 23 has reached its thread-catching position, pressure is admitted to the said pneumatic cylinder 48, and the said stop plate 50 is moved into an upper position, in which it is thus in the path of pivoting movement of the said hinge 47.

During the further course of the movement of the said needle thread loop around the bobbin housing, the end E of the needle thread is pulled under the said needle plate 14, after which the thread loop is untied, and the now freely hanging needle thread end NE is in contact with the said catch thread device 23 only by the thread section that formed the previous reserve-side loop leg NV.

The sewing machine briefly stops in the top dead center of the said take-up lever 5 during this first stitch formation cycle, and the said catch thread device 23 is returned by the said pneumatic cylinder 34 in the direction of its starting position, while it carries the needle thread end NE and pulls it under the said end piece 45 of the said leaf spring 44.

The said stop plate 50, located in the path of pivoting movement of the said hinge 47, causes the said catch thread device 23 not to be able to have been completely withdrawn into its starting position at this point in time, but to stop in the position shown in FIG. 12, in which its said front section 40 is located under the said end piece 45, forms the said thread clamp 46 together with it, and the said edge 39 is still at a spaced location from the said cutting edge 43 of the said cutting knife 42. In this position of the said catch thread device 23, the needle thread end NE arriving from the said stitch hole 51 extends between the said end piece 45 and the said front section 40 of the said catch thread device 23, and is clamped between them. From this point of clamping, the needle thread end NE then extends under and through the said cutting edge 43, beyond the said slotted hole 38, and through the said groove 37, after which it hangs down freely from the foot of the said barb 36.

Since the said angle lever 29 is coupled with the said piston rod 33 of the said pneumatic cylinder 34 in a positive-locking manner, its piston, not shown, is also prevented by the said stop plate 50 from moving into its end position.

After the needle thread end NE has been introduced into the said thread clamp 46, the sewing machine performs the second stitch formation cycle. Pressure is admitted to the said pneumatic cylinder 34 during this time, as a result of which the said hinge 47 is maintained in contact with the said stop plate 50, and the said catch thread device 23 is maintained in the thread-clamping position. Since the needle thread end NE is held during the second stitch formation cycle, the said hook is able to pull out a complete needle thread loop, lead it around the bobbin housing, and catch the free end of the hook thread G. The needle thread loop is then withdrawn by the subsequent upward movement of the said take-up lever 5, and the first connection of needle thread and hook thread is tightened in the fabric being sewn.

The sewing machine is again stopped briefly at the top dead center during the second stitch formation cycle, and the said pneumatic cylinder 48 is then reversed, as a consequence of which it pulls the said stop plate 50 out of the path of pivoting movement of the said hinge 47. As a consequence, the piston, not shown, of the said pneumatic cylinder 34, which continued to be pressurized, is returned into its end position, and the said catch thread device 23 is pivoted back into its starting position according to FIGS. 2 and 3. Part of the needle thread end NE is now cut off due to the cooperation of the said cutting edge 43 and the said edge 39. The needle thread end, shortened after thread cutting at the beginning of the seam, has the same length as the thread ends that remain on the fabric after the thread cutting performed at the end of the seam. So-called thread bunches at the beginning of the seam are reliably avoided by the shortening of the needle thread end at the beginning of the seam.

Exemplary Embodiment 2

In the second exemplary embodiment shown in FIG. 5, the design of the sewing machine, including the hook, is identical to that of the first exemplary embodiment, so that identical components are designated by the same reference numerals. This also applies to the thread-cutting device designated by reference numeral 60, i.e., its design from the said catch thread device 23 up to and including the said angle lever 29 is identical to that of the said thread-cutting device 22. Furthermore, the said thread-cutting device 60 also has a said leaf spring 44, which is arranged above the said cutting knife 42 and forms a thread clamp together with the said catch thread device 23, which is in a defined position. Finally, as in the first exemplary embodiment, a said pneumatic cylinder 48, which carries a said stop plate 50, is associated with the said hinge 47 of the said angle lever 29.

The drive for the said catch thread device 23 is derived, similarly to that described in DE 38,19,135 C1, from a cam 61, which is attached to the said main shaft 13 and has a control groove 62 and a control segment (63). An axially displaceable shaft 64 is arranged in parallel to the said main shaft 13. A control lever 66, provided with a roller pin 65, and a release lever 67 are attached to the said shaft 64. A detent pawl 69 is mounted freely rotatably on a bearing bush 68 of the said shaft 64. A spring 70, which is wound around the said shaft 64, and is in contact with the said control lever 66 at one end and with the said detent pawl 69 at the other end, causes the said detent pawl 69 to pivot in the direction of the said control segment 63 and the said roller pin 65 to pivot out of the said control groove 62. At the same time, the said spring 70 acts as a compression spring and displaces the said shaft 64 into the right-hand end position shown in FIG. 5, in which the said roller pin 65 is located opposite the said control groove 62 when the needle of the sewing machine is in its deep position.

A spring-loaded starting lever, not shown, which can be actuated by an electromagnet, likewise not shown, is associated with the said release lever 67. The design and the arrangement of the said starting lever correspond to those of the starting lever of the prior-art thread-cutting device according to DE 38,19,135 C1.

A locking piece 71 is fastened to the side of the said control lever 66 located in its right-hand end position; the said locking piece 71 is designed and arranged such that it forms an axially acting movement barrier for the said control lever 66 only in the resting position of the said control lever 66 that is remote from the said cam 61, but the said control lever 66 pivoted into its operating position is able to move under it.

At the end of the said shaft 64 facing the said hook 15, a carrier piece 72 is mounted rotatably, but in an axially fixed position. The said carrier piece 72 is connected to the said arm 31 of the said angle lever 29 via a telescoping connecting rod 73. The said telescoping connecting rod 73 has a bar 74, which is hinged to the said angle lever 29 at one end, is provided with threads at its other end, and is screwed together with a sleeve 75 of corresponding design. A piston-like stop piece 76, which is attached to one end of a bar 77 passing through the bottom of the said sleeve 75, is accommodated in the said sleeve 75. The other end of the said bar 77 is hinged to the said carrier piece 72. A transversely projecting pin 78, which passes through an elongated hole 79 in the said sleeve 75, is arranged in the said stop piece 76. A compression spring 80 arranged in the said sleeve 75 holds the said stop piece 76 in the starting position shown in FIG. 5, in which the said pin 78 is in contact with the left-hand end of the said elongated hole 79.

A compressed air line 81, which has an open end piece 82 located above the said hook 15, is laid under the said base plate 2. The section of the said compressed air line 81 located in front of the said end piece 82 extends essentially in parallel to the axis of rotation of the said hook, so that a compressed air flow discharged from the said end piece 82 is also directed essentially in parallel to the axis of rotation of the said hook, and extends to the left in the direction of its front side from the rear side of the said hook 15 according to FIG. 5.

Mode of Operation

Because of the rigid association of the said cam 61 with the said main shaft 13, the said catch thread device 23 in the exemplary embodiment according to FIG. 5 can be moved into its thread-catching position only in the same relative rotary position of the said hook 15 during the two different cutting processes, i.e., during both thread cutting at the end of the seam and shortening of the needle thread end at the beginning of sewing.

Since it is necessary, during thread cutting at the end of the seam, for the said catch thread device 23 to catch only the fabric-side leg of the needle thread loop, the said catch thread device 23 is moved from its starting position into the thread-catching position, as was explained in the first exemplary embodiment, only when the said thread guide plate 18 has already withdrawn from the two legs NN and NV of the needle thread loop, and these [legs] extend at different angles in relation to the said stitch hole 51, the fabric-side loop leg NN extending on the front side of the said bobbin case 20 and the reserve-side loop leg NV extending on the rear side of the said bobbin case holder 19.

Since, in contrast, the reserve-side loop leg NV is to be caught and fed to the said cutting knife 42 for shortening the needle thread end at the beginning of sewing, it must be ensured in the second exemplary embodiment that the reserve-side loop leg NV will be in a position suitable for catching despite the dropping off of the said thread guide plate 18. To achieve this, compressed air is fed into the said compressed air line 81 with the beginning of the first stitch formation cycle. The compressed air flow discharged from the said end piece 82 now presses the reserve-side loop leg NV, after it drops off from the said thread guide plate 18, in the direction of the front side of the said hook 15, and the intensity of the compressed air flow is selected to be such that the reserve-side loop leg NV will assume essentially the same position in the area of the path of movement of the said catch thread device 23 as it does at the time when both loop legs NN and NV are still in contact with the said thread guide plate 18.

To shorten the needle thread end at the beginning of sewing, the sewing machine is briefly stopped during the first stitch formation cycle with the needle in the deep position. In this position of the sewing machine, the said control groove 62 of the said cam 61 assumes a position in which the said roller pin 65 can be moved into the said control groove 62 by a simple pivoting movement of the said control lever 66.

By actuating a switch during the pressing of the foot pedal of the sewing direction in the reverse direction, the electromagnet associated with the said thread-cutting device 60 is briefly switched on, and the drive motor of the sewing machine is then turned on again. Via the starting lever, not shown, and the said release lever 67, the said control lever 66 is pivoted by the said electromagnet, and the said roller pin 65 is pivoted into the said control groove 62. At the same time, the said spring 70 pivots the said detent pawl 69, which will then secure the position of the said control lever 66 pivoted into the operating position.

During the following revolution of the said main shaft 13, an obliquely extending section of the said cam 62 displaces the said shaft 64 from the starting position according to FIG. 5 to the left via the said control lever 66. This movement is transmitted via the said telescoping connecting rod 73 onto the said angle lever 29, as a consequence of which the said catch thread device 23 moves from its starting position into the thread-catching position shown in FIGS. 10 and 11. As was explained above, the movement of the said catch thread device 23 takes place at a time at which the said thread guide plate 18 has already withdrawn from the two loop legs NN and NV. However, the compressed air flow being discharged from the said end piece guarantees that the two loop legs NN and NV will be located on the side of the said catch thread device 23, on which the said barb 36 is located. After the said catch thread device 23 has reached its thread-catching position, pressure is admitted to the said pneumatic cylinder 48, and the said stop plate 50 moves into an upper position, in which it will be in the path of pivoting movement of the said hinge 47.

During the further course of the looping movement of the needle thread loop around the bobbin housing, the end E of the needle thread is pulled under the said needle plate 14, after which the needle loop leg is untied, and the needle thread end NE is in contact with the said catch thread device 23 only by the thread section which formed the previous reserve-side loop leg NV.

The said control groove 62 is designed such that at the time of the top dead center of the said take-up lever 5, it will have moved the said catch thread device 23 back in the direction of its starting position. The needle thread end NE is carried by the said hook 36 and pulled under the said leaf spring 44 by the return movement of the said catch thread device 23.

The said stop plate 50, which is located in the path of pivoting movement of the said hinge 47, causes the said catch thread device 23 to be unable to be completely withdrawn into its starting position at this point in time, but to stop, in the same manner as in the first exemplary embodiment, in the position shown in FIG. 12, and to hold the needle thread end NE clamped.

Since the said control lever 66 is in positive-locking connection with the said cam 61 during the engagement of the said roller pin 65 in the said control groove 62, the said control lever 66 is pushed back into its starting position despite the said stop plate 50 being in the path of pivoting movement of the said hinge 47. The said bar 77 with the said stop piece 76 is now displaced in relation to the fixed sleeve 75, as a result of which the said compression spring 80 is tensioned.

By the end of the return movement of the said control lever 66, the said control segment 63 pivots the said detent pawl 69, as a result of which the said starting lever, not shown, is released, and returns into its starting position. As a result, the said spring 70 is able to push the said control lever 66 away from the said control groove 62. In this position of the said control lever 66, the said tensioned compression spring 80 holds the said control lever 66 in lateral contact with the said locking piece 71.

After the needle thread end NE has been introduced into the said thread clamp 46, the sewing machine performs the second stitch formation cycle. The said tensioned compression spring 80 causes the said hinge 47 to be held in contact with the said stop plate 50 and the said catch thread device 23 to be held in the thread-clamping position. Since the needle thread end NE is fixed during the second stitch formation cycle, the said hook 15 is able to pull a complete needle thread loop, to lead it around the bobbin housing, and to catch the free end of the hook thread G. The needle thread loop is then withdrawn by the subsequent upward movement of the said take-up lever 5, and the first thread connection is tightened by the needle thread and the hook thread in the fabric being sewn.

The sewing machine is again stopped briefly at the top dead center of the said take-up lever 5 during the second stitch formation cycle, and the said pneumatic cylinder 48 is then reversed, as a consequence of which it pulls the said stop plate 50 out of the path of pivoting movement of the said hinge 47. As a consequence of this, the said compression spring 80 moves the said sleeve 75 back into the end position shown in FIG. 5, and pivots the said catch thread device 23 into its starting position. Part of the needle thread end NE is now cut off in the same manner as in the first exemplary embodiment. The thread section cut off is blown away from the said hook 15 by the air flow that still continues to be discharged from the said end piece 82, so that this thread section is reliably prevented from being accidentally sewn in during one of the subsequent stitch formation processes. To accomplish this additional function. the compressed air supply is stopped only after expiration of an adjustable time after the shortening of the needle thread end.

The air flow also has the further advantageous effect that it keeps the loose hook thread end out of the catching area of the said barb 36 during the pivoting of the said catch thread device 23 into the thread-catching position. Based on these advantageous additional effects of the air flow, it may be advantageous to provide a compressed air line comparable to the said compressed air line 81 in the first exemplary embodiment as well.

Exemplary Embodiment 3

Figure 6:
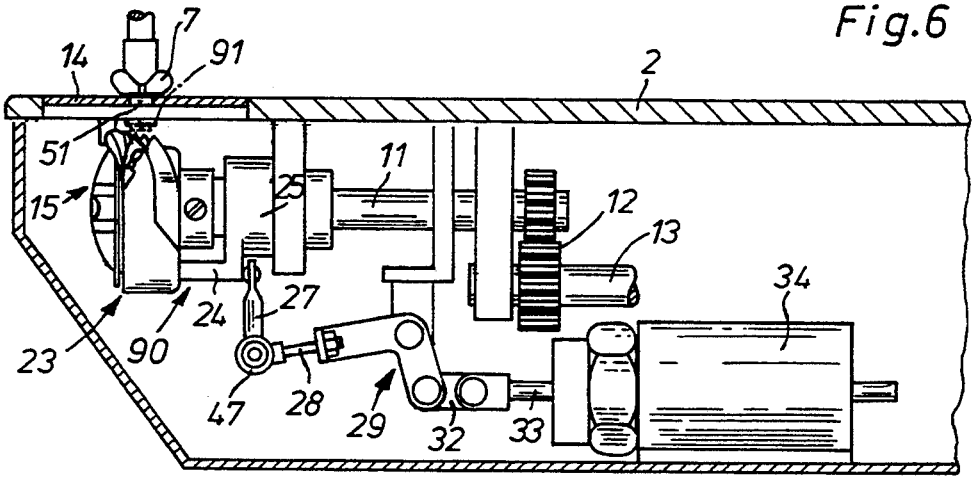
FIG. 6 is a partially cutaway view of a partial area of a sewing machine with a thread-cutting device of another exemplary embodiment.
Figure 7:
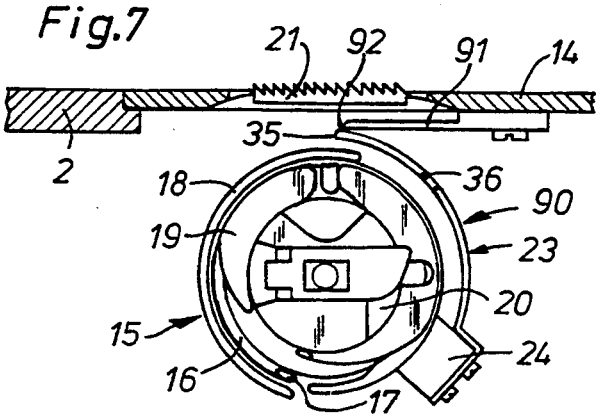
FIG. 7 is an enlarged side view of the hook and of the thread-cutting device in FIG. 6.

In the third exemplary embodiment shown in FIGS. 6 and 7, the design of the sewing machine, including that of the said hook, is identical to that of the first exemplary embodiment, so that identical components are designated by the same reference numerals.

The thread-cutting device 90 is identical to the corresponding parts of the said thread-cutting device 22 in terms of the arrangement of the catch thread device and the design of the drive device for the catch thread device, so that identical components of the said thread-cutting device 90 are designated by the corresponding reference numerals of the said thread-cutting device 22.

The said thread-cutting device 90 differs from the said thread-cutting device 22 in that no thread clamp and no locking member that can be introduced into the path of movement of the said hinge 47 of the said angle lever 29 are provided. Furthermore, a cutting knife 91, which is attached to the said needle plate 14, and whose cutting edge 92 is located at a shorter distance from the said stitch hole 51 than is the said cutting edge 43 in the first exemplary embodiment, is provided, instead of the cutting knife attached to a projection of the said base plate 2. The shorter distance between the point of cutting of the said thread-cutting device 90 and the said stitch hole 51 leads to a correspondingly elongated design of the said catch thread device 23. The front area of the said catch thread device 23, i.e., the area extending from the said barb to the said separating tip may have the same design as in the said catch thread device 23 according to the first exemplary embodiment.

Mode of Operation

Due to the use of the said pneumatic cylinder 34, to which pressure can be admitted at any time, for driving the said catch thread device 23, the mode of operation of the third exemplary embodiment is identical to the mode of operation of the first exemplary embodiment to the extent that the said catch thread device 23 is pivoted into the thread-catching position for shortening the needle thread end at the beginning of sewing at a time at which the end section of the said thread guide plate 18 is still in the area of the said stitch hole 51 in this case as well, and the two legs NN and NV of the needle thread loop are in contact, next to each other, with the said thread guide plate 18, as shown in FIGS. 8 and 9.

During the further course of the first stitch formation cycle, the said hook 15 pulls the end of the needle thread under the said needle plate 14, as in the first exemplary embodiment, after which the thread loop is untied, and only the section of the needle thread that previously formed the reserve-side loop leg NV is subsequently in contact with the said catch thread device 23.

The sewing machine is briefly stopped at the dead center of the said take-up lever 5 during this first stitch formation cycle, and the said pneumatic cylinder 34 is reversed. As a result, the said catch thread device 23 is returned into its starting position, and it carries the needle thread end NE. In contrast to the first exemplary embodiment, the said catch thread device 23 is completely returned into the starting position without interruption in the present, third exemplary embodiment, and part of the needle thread end NE is cut off. Due to the particularly short distance between the said cutting edge 92 and the said stitch hole 51, a particularly short needle thread end is thus obtained on the fabric being sewn.

After the first stitch formation process, the fabric being sewn is fed by the said feed dog 21 of the sewing machine to the extent that the section of the needle thread located within the fabric will come under the said pressure foot 7, and is held between this and the said needle plate 14 in a frictionally engaged manner. The holding force now acting on the needle thread end is sufficient to guarantee that the needle thread loop will be formed completely and led around the bobbin case during the next stitch formation cycle, so that satisfactory connection of the needle thread to the hook thread takes place.

Exemplary Embodiment 4

The design of the sewing machine shown in FIG. 13 is identical to that of the sewing machine according to the first exemplary embodiment, so that identical components are designated by the same reference numerals.

A thread-cutting device 100, which essentially corresponds to the said thread-cutting device 22 according to the first exemplary embodiment, is arranged under the said base plate 2. To illustrate this fact, the components of the said thread-cutting device 100 in the fourth exemplary embodiment, which are identical to those according to the first embodiment, are provided with the same reference numerals. Thus, the said thread-cutting device 100 has a catch thread device 101, which is arranged coaxially to the said hook 15, and is in its starting position in FIG. 14. The said catch thread device 101 is attached to a said arm 24 of a said sleeve 25, which is rotatably mounted on a said bearing bush 26 of the said hook drive shaft 11. A said connecting rod 27 is hinged to the said arm 24, and the said connecting rod 27 is connected to a said longitudinally adjustable arm 28 of a said angle lever 29, which is carried by a said bearing block 30 that is an integral part of the housing. The said other arm 31 of the said angle lever 29 is connected via a said connecting rod 32 to the said piston rod 33 of a said pneumatic cylinder 34. The design and the control circuit of the said pneumatic cylinder 34 correspond to the pneumatic cylinder and the pneumatic cylinder control circuit for a thread-cutting device, which are disclosed in DE 32,44,996 C2.

The said catch thread device 101 has a separating tip 102 designed at its free end (FIG. 16), and a thread-catching barb 103, which is directed in the opposite direction, is formed by an incision 104, and represents a first catching element. A fiat groove 105, which opens into a continuous elongated hole 106, is designed at the foot of the said barb 103. The edge 107 of the said elongated hole 106 adjacent to the said separating tip 102 is designed as a sharp edge, and is used as a cutter.

A continuous hole 108, whose limiting surface 109 forms a second catching element, is provided in the said catch thread device 101 at a laterally spaced location from the said incision 104. The said hole 108 is connected to the said elongated hole 106 via a flat groove 110. The front section of the said catch thread device 101 between the said separating tip 102 and the said edge 107 is designated by 111.

A cutting knife 112, whose cutting edge 113 is located at a relatively short distance from the said stitch hole 51 of the said needle plate 14, is fastened to the underside of the said needle plate 14.

Mode of Operation

The mode of operation of the said thread-cutting device 100 during thread cutting at the end of the sewing process is the same as that of the thread-cutting device according to DE 32,44,996 C2, so that this function does not need to be explained in greater detail. It should only be pointed out that the said catch thread device 101 is moved here from its starting position into the thread-catching position only when the said thread guide plate 18 has already withdrawn from the two legs NN and NV of the needle thread loop, or the legs NN and NV have fallen off from the said thread guide plate 18. This point in time is of significance because, in the case of a double rotary hook doubly rotating around a horizontal axis, the fabric-side loop leg NN is moved past the front side of the said bobbin case 20, and the reserve-side loop leg NV is moved past the rear side of the said bobbin case holder 19, so that the two legs NN and NV extend, after falling off from the said thread guide plate 18, at different angles in relation to the said stitch hole 51 of the said needle plate 14. In this thread course, the said catch thread device 101 with its said separating tip 102 can be reliably moved between the two loop legs NN and NV, and the fabric-side loop leg NN is caught by the said barb 103 and fed to the said cutting knife 113 during the return movement of the said catch thread device 101, and the reserve-side loop leg NV is kept away from the said cutting knife 113. The cutting off of the fabric-side loop leg NN leads, as desired, to a short needle thread end on the fabric in the area of the end of the seam, on the one hand, and, on the other hand, a long reserve-side needle thread end, which is necessary for the reliable connection of the needle thread end to the hook thread at the beginning of the next sewing process, is obtained. The common term "needle thread end," which is designated by the reference NE, is defined here as the thread section extending from the said needle 4 to the actual end E of the needle thread.

Pressure is admitted to the said pneumatic cylinder 34 prior to the beginning of the first stitch formation cycle, as a consequence of which the said catch thread device 101 is moved from its starting position shown in FIGS. 13 and 14 into the thread-catching position shown in FIGS. 15 and 20, in which the path of movement N of the said needle 4 passes through the center of the said hole 108.

At the beginning of the first stitch formation cycle carried out subsequently at reduced speed, the said needle 4 pulls a section of the loose needle thread end NE through the said stitch hole 51 and the said hole 108 of the said catch thread device 101 in the downward direction (it is achieved due to the said thread wiper 8 that the needle thread end NE will not come under the said pressure foot 7 and will not be held by same), after which the needle thread end NE is caught by the said hook tip 17 and is moved as a thread loop around the bobbin housing formed by the said bobbin case holder 19 and the said bobbin case 20. As was mentioned, the reserve-side loop leg NV now extends behind the said bobbin case holder 19, while the other loop leg, which leads to the end E of the needle thread, extends on the front side of the said bobbin case 20. This loop leg is comparable to the loop leg that forms the fabric-side loop leg NN after the first stitch formation. The loop leg leading to the actual end E is therefore also designated by NN.

In the course of leading the needle thread loop around the bobbin housing, the end E of the needle thread is pulled under the said needle plate 14, after which the thread loop is untied, and the needle thread end NE will subsequently hang down freely from the said hole 108 of the said catch thread device 101. However, it is now guaranteed that the needle thread end NE always passes through the said hole 108, and is consequently caught by the said catch thread device 101, completely regardless of how and where the rest of the needle thread end NE extends.

The sewing machine is briefly stopped at the top dead center of the said take-up lever 5 during this first stitch formation cycle, and the said pneumatic cylinder 34 is reversed. As a result, the said catch thread device 101 is returned into its starting position, carrying the needle thread end NE with it. In contrast to the first exemplary embodiment, the said catch thread device 101 is returned completely into the starting position without interruption in this fourth exemplary embodiment, and part of the needle thread end NE is cut off. A particularly short needle thread end is obtained on the fabric here because of the particularly short distance between the said cutting edge 114 and the said stitch hole 51.

After the first stitch formation process, the fabric is fed by the said feed dog 21 of the sewing machine to the extent that the section of the needle thread located in the fabric will come under the said pressure foot 7 and be held between same and the said needle plate 14 in a frictionally engaged manner. The holding force now acting on the needle thread end is sufficient to guarantee the formation and complete leading of the needle thread loop around the bobbin housing during the next stitch formation cycle, so that satisfactory connection of the needle thread to the hook thread will take place.

Instead of the said catch thread device 101 shown in FIG. 16, it is also possible to use a catch thread device 121 designed according to FIG. 17 in the fourth exemplary embodiment. The said catch thread device 121 is essentially identical to the said catch thread device 101. It also has a separating tip 122 and a barb 123, which is formed by an incision 124 and represents a first catching element. Furthermore, a flat groove 125, which opens into a continuous elongated hole 126, is designed at the foot of the said barb 123. The edge 127 of the said elongated hole 126 adjacent to the said separating tip 122 is designed as a sharp edge and is used as a cutting edge.

A continuous hole 128, whose limiting surface 129 forms a second catching element, is provided in the said catch thread device 121 at a laterally spaced location from the said incision 124. The edge area 130 of the said hole 128, which faces the said separating tip 122 and is located on the top side of the said catch thread device 121, is designed as a sharp edge area, and is used as a cutting edge. The front section of the said catch thread device 121 between the said separating tip 122 and the said edge 127 is designated by 131. The said cutting knife 113 is associated with the said catch thread device 121, just as with the said catch thread device 101, but the cutting process is brought about in this case by the cooperation of the said sharp-edged edge area 130 of the said catch thread device 121 and the said cutting edge 114 of the said cutting knife 113. The rest of the mode of operation in the case of the use of the said catch thread device 121 is the same as in the case of the said catch thread device 101, so that a more detailed description is unnecessary.

Exemplary Embodiment 5

In the fifth exemplary embodiment shown in FIG. 18, the design of the sewing machine, including the hook, is identical to that of the fourth embodiment, so that identical components are designated by the same reference numerals. This also applies to the thread-cutting device designated by 140, i.e., its design from the said catch thread device 101 up to and including the said angle lever 29 is identical to that of the said thread-cutting device 100.

The drive for the said catch thread device 101 is derived, in the same manner as in the second exemplary embodiment according to FIG. 5, from the said cam 61, which is attached to the said main shaft 13 and has a said control groove 62 and a said control segment 63. A said axially displaceable shaft 64 is arranged in parallel to the said main shaft 13. A said control lever 66, provided with a said roller pin 65, as well as a said release lever 67 are fastened to the said shaft 64. A said detent pawl 69 is mounted freely rotatably on a said bearing bush 68 of the said shaft 64. A said spring 70, which is wound around the said shaft 64, and which is in contact with the said control lever 66 at one end and with the said detent pawl 69 at the other end, causes the said detent pawl 69 to be pivoted in the direction of the said control segment 63 and the said roller pin 65 to be pivoted out of the said control groove 62. At the same time, the said spring 70 acts as a compression spring, and displaces the said shaft 64 into the right-hand end position shown in FIG. 18, in which the said roller pin 65 is located opposite the said control groove 62 when the needle of the sewing machine is in the deep position. A spring-loaded starting lever, not shown, which can be actuated by an electromagnet, likewise not shown, is located opposite the said release lever 67.

A locking piece 71 is fastened to the side of the said control lever 66, which is in the right-hand end position. The said locking piece 71 is designed such that it forms an axially acting movement barrier for the said control lever 66 only when the said control lever 66 is in its resting position away frown the said cam 61, whereas the said control lever 66, pivoted into its operating position, is able to move under it.

At the end of the shaft 64 facing the said hook 15, the said carrier piece 72 is mounted rotatably, but in an axially fixed position. The said carrier piece 72 is connected to the said arm 31 of the said angle lever 29 via a said telescoping connecting rod 73. The said telescoping connecting rod 73 has a bar 74, which is hinged at one end to the said angle lever 29, whose other end is provided with threads, and is screwed together with a said sleeve 75 of a corresponding design. A said piston-like stop piece 76, which is fastened to one end of a said bar 77 passing through the bottom of the said sleeve 75, is accommodated in the said sleeve 75. The other end of the said bar 77 is hinged to the said carrier piece 72. A said transversely projecting pin 78, which passes through an elongated hole **79*a* in the said sleeve 75, is arranged in the said stop piece 76. The said elongated hole 79*a* is made considerably longer than the said corresponding elongated hole 79 in the second exemplary, embodiment according to FIG. 5. A said compression spring 80 arranged in the said sleeve 75 holds the said stop piece 76 in the starting position shown in FIG. 18, in which the said pin 78 is in contact with the left-hand end of the said elongated hole 79*a***.

An additional drive mechanism in the form of a stationarily arranged pneumatic cylinder 141, whose piston rod 142 carries a stop plate 143, is associated with the said thread-cutting device 140 [reference numeral 140 designates an edge area in Exemplary Embodiment 4—Tr. Ed.]. When pressure is admitted to the pneumatic cylinder 141, the stop plate 143 strikes the said hinge 47 of the said angle lever 29, and pivots the said catch thread device 101 into the catching position shown in FIGS. 15 and 20.

Mode of Operation.

Since the said catch thread device 101 in the exemplary embodiment according to FIG. 18 must be moved for shortening the needle thread end at the beginning of sewing in a hook position different from that during thread cutting at the end of the seam, but it cannot be driven by the said cam 61 in the manner necessary because of the permanent association of the said cam 61 with the said main shaft 13, the said catch thread device 101 is moved by means of the said pneumatic cylinder 141, prior to the beginning of the first stitch formation cycle, into its catching position, in which the path of movement N of the said needle 4 passes through the center of the said hole 108.

Since the said control lever 66 is in the resting position away from the said cam 61 during the forward movement of the said catch thread device 101 into the thread-catching position, in which position the said locking piece 71 forms an axially acting movement barrier for the said control lever 66 and the said shaft 64 carrying same, a relative movement correspondingly takes place between the said sleeve 74 driven by the said angle lever 29 and the said fixed stop piece 76 accommodated in the said sleeve 74, and the said compression spring 80 is compressed.

At the beginning of the first stitch formation cycle performed subsequently at reduced speed, the said needle 4 pulls part of the loose needle thread end NE through the said stitch hole 51 and into the said hole 108 of the said catch thread device 101, after which the needle thread end NE is caught by the said hook tip 17, and is completely pulled under the said needle plate 14, while the needle thread end NE, which is now hanging down freely, passes through the said hole 108.

The sewing machine is briefly stopped at the top dead enter of the said take-up lever 5 during this first stitch formation cycle, and the said pneumatic cylinder 141 is reversed. The said compression spring 80, which is now being released, subsequently pulls the said catch thread device 101 into the starting position shown in FIG. 18 via the said sleeve 74 and the said angle lever 29, and part of the needle thread end NE is cut off due to cooperation of the said edge 107 of the said catch thread device 101 with the said cutting edge 114 of the said cutting knife 113.

The fabric being sewn is fed by the said feed dog 21 after the first stitch formation cycle to the extent that the section of the needle thread located within the fabric being sewn will come under the said pressure foot 7 and will be held between this [the pressure foot] and the said needle plate 14 in a frictionally engaged manner. As a result, it is guaranteed that a complete needle thread loop can be formed during the next stitch formation cycle, as a consequence of which satisfactory connection of the needle thread to the hook thread can take place.

Exemplary Embodiment 6

In the sixth exemplary embodiment shown in FIG. 19, the design of the sewing machine, including the hook, is identical to that of the fifth exemplary embodiment according to FIG. 18, so that identical components are designated by the same reference numerals. This also applies to the thread-cutting device designated by 150, i.e., its said catch thread device 101 is in connection with the same drive mechanism as in the fifth exemplary embodiment. Since the corresponding components are identical, FIG. 19 shows only the said arm 28 of the said angle lever 29, and the rest of the drive mechanism is omitted.

A cutting knife 151, which is represented by dash-dotted lines in FIG. 19, and which is designed and arranged in the same manner as the said cutting knife 42 of the first exemplary embodiment shown in FIG. 2, is associated with the said catch thread device 101. A leaf spring 152, which is also represented by dash-dotted lines only, and forms a thread clamp 153 together with the said incision 111 of the said catch thread device 101, is fastened above the said cutting knife 151.

A one-armed lever 155 is provided on a stationarily mounted pin 154 under the said angle lever 29. A first pneumatic cylinder 156, which has a stop plate 158 fastened to the piston rod 157, is associated with the said lever 155. The said lever 155, whose free end is in contact with the said stop plate 158, extends essentially horizontally when the said piston rod 157 is withdrawn. The said pneumatic cylinder 156 is located essentially under the said hinge 47 of the said angle lever 29. A second pneumatic cylinder 159 of equal size, whose piston rod 160 carries a stop plate 161, is stationarily arranged at a laterally spaced location from the said first pneumatic cylinder 156. The contact point between the said stop plate 161 and the said lever 155 is located between the said pin 154 and the said contact point between the said stop plate 158 and the said lever 155. The said two pneumatic cylinders 156 and 159 form together an additional drive mechanism for the said thread-cutting device 150.

Mode of Operation

Prior to the beginning of the first stitch formation cycle, the said catch thread device 101 is moved by means of the said pneumatic cylinder 159 and of the said lever 155 acting on the said hinge 47 into its catching position, in which the path of movement N of the said needle 4 passes through the center of the said hole 108. The said compression spring 80 of the said telescoping connecting rod 73 is compressed during the forward movement of the said catch thread device 101 into the catching position in the same manner as in the fifth exemplary embodiment.

At the beginning of the first stitch formation cycle performed subsequently at reduced speed, the said needle 4 pubs part of the loose needle thread end NE through the said stitch hole 51 and the said hole 108 of the said catch thread device 101, after which the needle thread end NE is caught by the said hook tip 17 and is completely pulled under the said needle plate 14, and the needle thread end NE, which is now hanging down freely, passes through the said hole 108.

After the said catch thread device 101 has reached its thread-catching position, pressure is admitted to the said pneumatic cylinder 156, and the said stop plate 158 is moved into the top position, in which it is still located at a spaced location from the free end of the said lever 155, which is pivoted upward by means of the said other pneumatic cylinder 159.

The sewing machine is briefly stopped at the top dead enter of the said take-up lever 5 during this first stitch formation cycle, and the said pneumatic cylinder 159 is reversed. The said compression spring 80, which is being released, subsequently withdraws the said catch thread device 101 in the direction of its starting position, and the said catch thread device 101 carries the needle thread end NE passing through the said hole 108, and pubs it under the said leaf spring 152, as in the first exemplary embodiment.

The said stop plate 158 of the said pneumatic cylinder 156, which is in the raised position, causes the said catch thread device 101 not to be able to be completely withdrawn into its starting position at this point in time, but to stop in the position corresponding to FIG. 12, in which position its front section 111 is located under the end piece of the said leaf spring 152, forms the said thread clamp 153 together with it [the said leaf spring 152], and the said edge 107 is still located at a spaced location in front of the cutting edge of the said cutting knife 151. In this position of the said catch thread device 101, the needle thread end NE arriving from the said stitch hole 51 extends between the end of the said leaf spring 152 and the said front section 111 of the said catch thread device 101, and is clamped between them. The needle thread end NE extends from this point of clamping under the cutting edge of the said cutting knife 151, beyond the said elongated hole 106, through the said groove 110 and the said hole 108, to hang freely down from this [the said hole 108].

After the needle thread end NE has been introduced into the said thread clamp 153, the sewing machine performs the second stitch formation cycle. Since the needle thread end NE is now held, the said hook 15 is able to completely loop the needle thread around the bobbin housing, and to catch the free end of the hook thread G. The needle thread loop is then withdrawn by the subsequent upward movement of the said take-up lever 5, and the first thread connection of the needle thread with the hook thread is tightened.

The sewing machine is again stopped briefly at the top dead center of the said take-up lever 5 during the second stitch formation cycle, and the said pneumatic cylinder 156 is subsequently reversed, and the said stop plate 158 is returned into its lower position. The said compression spring 80, which is being increasingly released, subsequently causes the said catch thread device 101 to be returned into the starting position, and part of the needle thread end NE is cut off.

We claim:

1. Device for shortening the end of a needle thread at a beginning of a seam to be formed with a two-thread lockstitch sewing machine, comprising:

a needle bar with a thread guiding needle;

a pressure foot cooperating with said thread guiding needle;

a feed mechanism provided adjacent a needle plate for feeding fabric to be sewn;

a hook doubly rotating around a horizontal axis, said hook cooperating with said thread guiding needle to form Stitches, said hook being arranged under said needle plate;

a thread-cutting device, said thread cutting device including a catch thread device with a catching element with a thread-catching area, the catch thread device being moveable into a thread-catching position and a knife;

thread-cutting device drive means to be switched on at different angle positions of said hook for performing a thread-cutting process at an end of a seam, and for performing a cutting of an end of a needle thread at a beginning of a seam.

2. A device according to claim 1, wherein said thread-cutting device drive means includes a pneumatic cylinder.

3. A device according to claim 1, further comprising:

a compressed air line having an open end piece arranged and orientated under said needle plate in an area of said hook for discharging a compressed air flow from said end piece to extend above said hook from a rear side of said hook in a direction of a front side of said hook, and said compressed air line is substantially in parallel to an axis of rotation of said hook.

4. A device according to claim 1, wherein said catch thread device has a recess used to form an additional catching element, at least one of said catching element and said additional catching element being formed by a recess with an edge of said recess being formed as a cutting edge cooperating with said knife.

5. A device according to claim 4, wherein said recess has an edge area located on a top side of said catch thread device and directed opposite said knife, and formed as a cutting edge.

6. A device according to claim 4, Wherein said catch thread device has a cutting edge formed on a top side and cooperating with said knife, said recess being connected to said cutting edge via a thread-receiving groove.

7. A device according to claim 4, wherein said thread-cutting device drive means is a pneumatic cylinder for pivoting said catch thread device into two different positions including a position of said catch thread device in which the thread-catching position for thread-cutting at an end of a seam is also a position in which a path of movement of the needle passes through the recess.

8. A device according to claim 4, wherein said thread-cutting device drive means includes a cam driven by said sewing machine, and an additional drive mechanism is provided for moving said catch thread device into a position in which a path of movement of said needle passes through said recess, said thread-cutting device including a gear member formed as a spring-loaded gear member to build up a restoring force on actuation of said additional drive mechanism.

9. A device according to claim 8, wherein said spring-loaded gear member is formed by a telescoping connecting rod.

10. A device according to either claim 8 or 9, wherein said additional drive mechanism is formed by a pneumatic cylinder and acts with a pressing piece on said gear member of said thread-cutting device in a non-positive manner.

11. A device according to claim 1, wherein said thread-cutting device drive means is a pneumatic cylinder, a locking member being provided introducible into and removable from a path of one of said thread catch device, or of a gear of said thread-cutting device, said locking member having an operating position determining a point of clamping of said thread by said catch thread device.

12. A device according to claim 1, wherein said thread-cutting device drive means has a cam which is driven by said sewing machine;

a locking member is provided introducible into and withdrawable from a path of movement of one of said catch thread device or a gear member of said thread-cutting device, said locking member having an operating position determining a point of clamping of the thread by said catch thread device, a spring being provided acting on a gear member of said thread-cutting device to cause a compensating movement under increasing tension of said spring when said locking member is in an operating position.

13. A device according to claim 12, wherein said gear member being acted on by said spring is formed by a telescoping connecting rod connected to said gear member.

14. A device according to claim 12, wherein said catch thread device is provided with a recess, an additional drive mechanism being provided switchable into two operating positions for moving said catch thread device prior to a first stitch formation cycle into said catching position; said additional drive mechanism holding said catch thread device in a second operating position in a clamping position corresponding to said thread clamp.

15. A device according to claim 14, wherein said additional drive mechanism is formed by two pneumatic cylinders which perform different effective strokes.

16. A sewing machine cutting a needle thread at a beginning of a seam, the sewing machine comprising:

a thread guiding needle;

a hook means for cooperating with said thread guiding needle to form a plurality of stitches creating a seam, said hook being arranged under a needle plate;

a thread-cutting device, said thread cutting device including a catch thread device with a catching element with a thread-catching area, the catch thread device being moveable into a thread-catching position, said thread-cutting device including a knife;

thread-cutting device drive means for moving said catch thread device into and out of said thread catching position, said thread-cutting device drive means moving said catch thread device as a function of different angle positions of said hook means for performing a thread-cutting of a reserve leg of said needle thread during a first stitch of said plurality of stitches and for cutting a fabric leg of said needle thread during a last stitch of said plurality of stitches.

17. A sewing process for cutting a needle thread at a beginning of sewing a seam, the process comprising the steps of:

providing a sewing machine with a thread guiding needle and hook means for cooperating with said thread guiding needle to form stitches, said sewing machine including a knife and a catch thread device with a thread-catching area;

performing a plurality of stitch cycles with said needle and said hook means to form a plurality of stitches which create a seam;

moving said thread-catching device during a first stitch of said plurality of stitches to a thread catching position to position a reserve leg of a needle thread forming said first stitch in said thread catching area;

cutting said reserve leg of said first stitch between said thread catching area and said knife.

18. A process in accordance with claim 17, wherein:

said hook means is a doubly rotating two-thread lockstitch hook with a thread guide plate means for guiding said needle thread;

said moving of said thread-catching device taking place when said needle thread is in contact with said thread guide plate means.

19. A process in accordance with claim 17, wherein:

said hook means is a doubly rotating two-thread lockstitch hook with a thread guide plate means for guiding said needle thread, said hook means positioning a fabric leg of said needle thread in said thread catching position and positioning said reserve leg spaced from said thread catching position after said needle thread moves past said thread guiding plate means;

said thread-catching device is moved into said thread catching position during a last stitch of said plurality of stitches to position said fabric leg in said thread-catching area;

said fabric leg of said last stitch is cut between said thread catching area and said knife;

said moving of said thread-catching device during said first stitch into said thread catching position taking place when said needle thread has moved past said thread guide means and said hook means has moved said reserve leg from said thread catching position, and said reserve leg being moved into said thread catching position by an auxiliary means.

20. A process in accordance with claim 17, wherein:

said catch thread device defines a recess forming an additional thread catching area, said additional thread catching area being positioned in a path of said needle when said catch thread device is in said thread catching position;

said catch thread device is moved to said thread catching position during said first stitch before said needle cooperates with said hook means.

21. A process in accordance with claim 17, further comprising:

a clamp piece connected to said sewing machine includes;

moving said catch thread device with said reserve leg during said first stitch from said thread catching position partially towards a starting position and clamping said reserve leg between said catch thread device and said clamp piece;

further moving said catch thread device to said starting position after completion of a second stitch of said plurality of stitches to perform said cutting of said reserve leg.

* * * * *